US009180063B2

(12) United States Patent
Friedman

(10) Patent No.: US 9,180,063 B2
(45) Date of Patent: Nov. 10, 2015

(54) SYSTEMS AND METHODS FOR ASSISTED AMBULATION

(71) Applicant: SCOTT & WHITE HEALTHCARE (SWH), Temple, TX (US)

(72) Inventor: Paul A. Friedman, Temple, TX (US)

(73) Assignee: SCOTT & WHITE HEALTHCARE (SWH), Temple, TX (US)

( * ) Notice: Subject to any disclaimer, the term of this patent is extended or adjusted under 35 U.S.C. 154(b) by 0 days.

(21) Appl. No.: 14/096,909

(22) Filed: Dec. 4, 2013

(65) Prior Publication Data

US 2014/0190536 A1 Jul. 10, 2014

Related U.S. Application Data

(60) Provisional application No. 61/733,305, filed on Dec. 4, 2012.

(51) Int. Cl.

| | |
|---|---|
| ***A61H 3/00*** | (2006.01) |
| ***G08C 19/00*** | (2006.01) |
| *A61G 5/00* | (2006.01) |
| *A61H 3/02* | (2006.01) |
| *A61H 3/04* | (2006.01) |
| *G08B 21/04* | (2006.01) |

(52) U.S. Cl.

CPC *A61H 3/00* (2013.01); *G08C 19/00* (2013.01); *A61G 5/00* (2013.01); *A61H 3/02* (2013.01); *A61H 3/04* (2013.01); *A61H 2003/0205* (2013.01); *A61H 2201/0184* (2013.01); *A61H 2201/5007* (2013.01); *A61H 2201/5028* (2013.01); *A61H 2201/5048* (2013.01); *A61H 2201/5069* (2013.01); *A61H 2201/5097* (2013.01); *G08B 21/0415* (2013.01); *G08B 21/0461* (2013.01)

(58) Field of Classification Search

USPC ..... 135/65, 66, 67

See application file for complete search history.

(56) References Cited

U.S. PATENT DOCUMENTS

| | | | | |
|---|---|---|---|---|
| 5,311,880 | A * | 5/1994 | Lancaster et al. | 600/595 |
| 5,511,571 | A * | 4/1996 | Adrezin et al. | 135/66 |
| 5,853,219 | A | 12/1998 | Santuccio | 297/5 |
| 6,011,481 | A | 1/2000 | Luther et al. | 340/686.1 |
| 6,745,786 | B1 | 6/2004 | Davis | 135/65 |
| 6,930,603 | B2 | 8/2005 | Jackson | 340/539.12 |
| 7,385,514 | B2 | 6/2008 | Dempsey | 340/573.1 |
| 7,826,983 | B2 * | 11/2010 | Alwan et al. | 702/33 |
| 7,901,368 | B2 | 3/2011 | Flaherty et al. | 601/5 |

(Continued)

OTHER PUBLICATIONS

Madeira, et al., "Designing a Pervasive Healthcare Assistive Environment for the Elderly," Sep. 29, 2010.

(Continued)

*Primary Examiner* — David R Dunn
*Assistant Examiner* — Danielle Jackson
(74) *Attorney, Agent, or Firm* — Norton Rose Fulbright US LLP

(57) ABSTRACT

Cognitive orthotics. More specifically, assistive ambulation systems and methods, including systems that can detect a person who uses an assistive ambulation device (such as a walker) and produce a signal in response to the detection, which signal is designed to encourage or motivate the person to use the device. They system may also stop the signal when the person engages the device and/or produce an additional signal or a different signal when the person engages the device.

43 Claims, 3 Drawing Sheets

(56) References Cited

U.S. PATENT DOCUMENTS

| | | | | |
|---|---|---|---|---|
| 7,963,294 | B1 * | 6/2011 | Trout | 135/66 |
| 8,702,567 | B2 * | 4/2014 | Hu et al. | 482/8 |
| 8,810,407 | B1 * | 8/2014 | Nolan et al. | 340/573.1 |
| 2004/0095251 | A1 | 5/2004 | Jackson | 340/686.6 |
| 2004/0130452 | A1 | 7/2004 | Cherubini | 340/573.7 |
| 2005/0077345 | A1 | 4/2005 | March | 235/95 R |
| 2006/0206167 | A1 | 9/2006 | Flaherty et al. | 607/48 |
| 2006/0292533 | A1 * | 12/2006 | Selod | 434/247 |
| 2007/0000531 | A1 * | 1/2007 | Russo | 135/66 |
| 2007/0243855 | A1 | 10/2007 | Hoffman et al. | 455/404.2 |
| 2007/0255186 | A1 * | 11/2007 | Grill | 600/595 |
| 2009/0009320 | A1 | 1/2009 | O'Connor et al. | 340/539.12 |
| 2009/0260426 | A1 * | 10/2009 | Lieberman et al. | 73/65.01 |
| 2010/0100013 | A1 | 4/2010 | Hu et al. | 600/595 |
| 2011/0023920 | A1 | 2/2011 | Bolton et al. | 135/66 |
| 2011/0118898 | A1 * | 5/2011 | Fu et al. | 701/1 |
| 2012/0085377 | A1 | 4/2012 | Trout | 135/66 |
| 2012/0119920 | A1 | 5/2012 | Sallop | 340/686.6 |
| 2012/0151678 | A1 | 6/2012 | Richards | 5/613 |

OTHER PUBLICATIONS

Frizera, et al., "The Smart Walkers as Geriatric Assistive Device. The SIMBIOSIS Purpose," Jan. 30, 2008.

* cited by examiner

SYSTEMS AND METHODS FOR ASSISTED AMBULATION

CROSS-REFERENCE TO RELATED APPLICATIONS

This application claims priority to U.S. Provisional Patent Application No. 61/733,305, filed Dec. 4, 2012, which is incorporated by reference in its entirety.

BACKGROUND

1. Field of the Invention

The present invention relates generally to cognitive orthotics and assisted ambulation, and more particularly, but not by way of limitation, to assistive ambulation systems and methods.

2. Description of Related Art

Examples of assistive ambulation systems and methods are shown in, for example, U.S. Pat. Nos. 6,930,603; 6,745,786; and 7,901,368, and U.S. Patent Publication No. 2012/0119920.

SUMMARY

Broadly, embodiments of the present invention function as a cognitive orthosis to provide cuing to the user of an assistive ambulation device to encourage use of the assistive ambulation device. Some embodiments of the present systems and methods function to effectively determine the user's intention within that person's living environment such that graded cuing can be provided to the user appropriate to their intention to stand and walk. Some embodiments of the present systems and methods provide a pleasant, engaging experience for the assistive ambulation device user that promotes use of the assistive ambulation device. Some embodiments of the present systems and methods may provide or effect remote activation of ambient lighting in certain circumstances. In some embodiments, one or more of the encouraging cues can be deactivated once the user has activated one or more sensors. For example, in some embodiments, one or more of the encouraging cues can be deactivated by appropriate hand placement on the assistive ambulation device. Some embodiments may also include an autodialer (e.g., which can be a phone (e.g., a land line or cellular phone), a computer, and/or can communicate with a phone or computer (e.g., via the Internet, Bluetooth, and other available wired and wireless communication means)) that can be activated when an unusual use and/or a lack of use is detected.

This disclosure includes embodiments of assistive ambulation systems and methods. Some of the systems are configured so that when the system is coupled to an assistive ambulation device—such as a walker (e.g., a front-wheeled walker, a four-wheel walker/rollator, a hemi-walker, and the like), a cane (e.g., a wide-based quad cane, a narrow-based quad cane, a straight cane with a foot-device (e.g., enabling the straight cane to remain upright if not contacted by a user), a single-point, straight cane, and the like), a wheelchair (e.g., a power wheelchair), a scooter (e.g., a power scooter), and similar assistive devices (e.g., such as those configured to maintain a directional orientation with respect to the user, those configured to maintain an upright orientation without contact by a user, and those that are not configured to maintain an upright orientation without contact by a user)—the system can detect a person and produce multiple signals that begin at different times depending on the proximity of a user to the device. Some of the systems are configured so that when the system is coupled to an assistive ambulation device the system can detect a person that has not yet engaged the device and produce a signal, and also detect when a person has engaged the device and stop the production of the signal and/or produce a different signal in response to the person's engagement with the device. In some such embodiments, the system is configured as a kit that can be retrofitted to an existing assistive ambulation device, and in other embodiments, the system includes the assistive ambulation device.

The present systems can, for example, communicate with remote devices via radio waves. Some embodiments of the present systems communicate with remote devices via telephonic radio waves; and other embodiments of the present systems communicate with remote devices via the Internet. In still other embodiments, the present systems can be autonomous in that the system does not communicate with remote devices and, instead, for example, can record information relating to system with, for example, a recording device, enabling increased privacy for a user.

Some embodiments of the present assistive ambulation systems are designed to encourage the user to engage and use the assistive ambulation device to which the system is coupled, such as by producing feedback in one or multiple different forms that are, at least for some period of time, pleasing and/or motivational to the user. For example, the feedback may take the form of an audio signal, which may comprise a sound or sounds that are pleasing or otherwise motivational to the user (such as music, a voice or voices, and/or words the user likes or that motivate the user). In other embodiments, the feedback may take the form of a visible signal, such as a light or lights that are pleasing or otherwise motivational to the user. In still other embodiments, the feedback may take the form of an olfactory signal, such as a scent or scents that are pleasing or otherwise motivational to the user. In some embodiments, the system may be configured such that the type of feedback depends on the proximity of the user to the device. For example, the system may be configured to detect that the user is some distance from the device, and produce a signal—such as an encouraging audio signal—designed to encourage the user to engage the device by grasping it with her hand(s); alternatively, or additionally, such systems may also be configured to halt the production of the signal in response to one or more events, such as the user grasping the assistive ambulation device. As another example, the system may also be configured to detect such grasping and produce a signal—such as a pleasing visible signal, like one or more lights—that is designed to be gratifying to the user. In some embodiments, the systems may be configured such that the duration of a given feedback signal is pre-programmed, while in other embodiments, the system may be configured such that the duration of a given feedback signal depends on the satisfaction of one or more criteria, or thresholds, such as the amount of time a user is in contact with a sensor responsive to direct user contact. Some embodiments of the present systems comprise a controller that includes a processor (such as a microprocessor) that, under the control of one or more algorithms through software and/or hardwiring, will be capable of processing input from one or more initiator sensors and/or one or more engagement sensors to activate one or more signaling devices to provide cuing to a user of the related assistive ambulation device that will encourage use of the assistive ambulation device.

Some embodiments of the present systems, which may be more specifically characterized as assistive ambulation systems, comprise an initiator sensor configured to detect a person; a controller couplable to the initiator sensor; a signaling device couplable to the controller, the controller configured to cause the signaling device to produce a signal based on input received by the controller from the initiator sensor after the initiator sensor detects a person; an engagement sensor couplable to the controller and configured to detect if a person has engaged the assistive ambulation device; and a power supply couplable to at least one of the controller, the initiator sensor, the signaling device, and the engagement sensor. In further embodiments, the systems comprise an assistive ambulation device coupled to the other components. In still further embodiments, the systems may include additional signaling devices couplable to the controller and capable of producing one or more additional signals that differ from each other in type, magnitude, etc., and that are responsive to a user, such as to the user's proximity to an assistive ambulation device.

The present systems can further include one or more global positioning system (GPS) units (e.g., an Augmented GPS system) that are couplable to a controller (e.g., wired or wirelessly) and further couplable to an assistive ambulation device. For example, a user's smart phone can function as a GPS unit for the system. In some embodiments, the GPS unit can be provided in a kit with other components of the system or acquired separately. The present systems can be configured such that, if one or more GPS units are coupled to an assistive ambulation device, the position of the assistive ambulation device can be determined (e.g., by a controller coupled to the assistive ambulation device, by a remote controller, etc.). Such GPS units can be coupled to any suitable location on the assistive ambulation device (e.g., handles, support bars, etc.) to, for example, enable or encourage communication between the one or more GPS units and a remote device (e.g., satellites used to assist in determining the position of the GPS unit(s)). If one or more GPS units are coupled to an assistive ambulation device, the position of the assistive ambulation device can be determined (whether indoors or outdoors), and the position of the assistive ambulation device can, over time, be recorded (e.g., by a recording device) or transmitted to a remote device (e.g., via a controller) such that a map of the assistive ambulation device's location—and, therefore, a map of a user's location—can be determined, providing information relating to user activity and range of movement.

The present controllers can include microprocessors (e.g., a computer or smart phone—and, more specifically, processing components of a computer or smart phone) that are controlled through hardwired logic (such as an application specific integrated circuit) or software (e.g., pre-loaded software, downloadable software (e.g., a mobile application), etc.), or that are programmable (such a field programmable gate array), that performs one or more of the functions and/or steps set forth in this disclosure, and the controllers can include any suitable storage devices for storing data, software, and/or hardware. For example, in some embodiments, software could be downloaded (e.g., as a courtesy or with a one-time or recurring subscription fee) from a website or from a mobile application marketplace. In some embodiments, one or more controllers (e.g., microprocessors) of the present disclosure can be positioned on the assistive ambulation device; and in other embodiments, one or more controllers (e.g., microprocessors) of the present disclosure can be positioned remotely from the assistive ambulation device, and the one or more controllers and the assistive ambulation device can communicate, for example, by a cloud computing network. If one or more controllers are positioned remotely from the assistive ambulation device, data can be processed remotely from the assistive ambulation device (e.g., in a centralized location) and transmitted wirelessly (e.g., via the Internet) to and from the assistive ambulation device and/or other devices in communication with the one or more controllers and/or the assistive ambulation device. Such a configuration could enable real-time and/or automatic software upgrades.

Some embodiments of the present kits comprise one or more controllers, one or more initiator sensors, one or more signaling devices, one or more engagement sensors, one or more recording devices, one or more transmitters, and/or one or more power supplies in any suitable combination. In some embodiments, the kits comprise instructions for use and/or assembly in a computer-readable form and/or a hard-copy form. In some embodiments, the kits may include a container that holds or otherwise contains some or all of these components.

Some embodiments of the present assistive ambulation methods comprise detecting a person with an assistive ambulation system coupled to an assistive ambulation device; signaling with the assistive ambulation system after the assistive ambulation system detects the person; and stopping the signaling when the assistive ambulation system detects that a person has engaged the assistive ambulation device. Some embodiments of the present assistive ambulation methods comprise detecting a person with an assistive ambulation system coupled to an assistive ambulation device; producing a first signal with the assistive ambulation system after the assistive ambulation system detects the person; and producing a second signal with the assistive ambulation system as a result of the assistive ambulation system detecting that a person has engaged the assistive ambulation device. In some embodiments, the methods further comprise recording information relating to the assistive ambulation system. In some embodiments, the methods further comprise transmitting to a remote device a signal relating to the assistive ambulation system.

The term "coupled" is defined as connected, although not necessarily directly, and not necessarily mechanically. Two items are "couplable" if they can be coupled to each other, and, when coupled, may still be characterized as "couplable." Unless the context explicitly requires otherwise, items that are couplable are also decouplable, and vice-versa. One non-limiting way in which a first structure is couplable to a second structure is for the first structure to be configured to be coupled (or configured to be couplable) to the second structure. The terms "a" and "an" are defined as one or more unless this disclosure explicitly requires otherwise. The term "substantially" is defined as largely but not necessarily wholly what is specified (and includes what is specified; e.g., substantially 90 degrees includes 90 degrees and substantially parallel includes parallel), as understood by a person of ordinary skill in the art. In any disclosed embodiment, the terms "substantially," "approximately," and "about" may be used to characterize a given relationship or condition, and may be substituted with "within [a percentage] of" what is specified, where the percentage includes 0.1, 1, 5, and 10 percent.

The terms "comprise" (and any form of comprise, such as "comprises" and "comprising"), "have" (and any form of have, such as "has" and "having"), "include" (and any form of include, such as "includes" and "including") and "contain" (and any form of contain, such as "contains" and "containing") are open-ended linking verbs. As a result, an assistive ambulation system or device (or a component of such a system or device) that "comprises," "has," "includes," or "contains" one or more elements or features possesses those one or more elements or features, but is not limited to possessing only those elements or features. Likewise, a method that "comprises," "has," "includes," or "contains" one or more steps possesses those one or more steps, but is not limited to possessing only those one or more steps. Additionally, terms such as "first" and "second" are used only to differentiate structures or features, and not to limit the different structures or features to a particular order or number.

Any embodiment of any of the present systems and methods can consist of or consist essentially of—rather than comprise/include/contain/have—any of the described elements and/or features. Thus, in any of the claims, the term "consisting of" or "consisting essentially of" can be substituted for any of the open-ended linking verbs recited above, in order to change the scope of a given claim from what it would otherwise be using the open-ended linking verb.

The feature or features of one embodiment may be applied to other embodiments, even though not described or illustrated, unless expressly prohibited by this disclosure or the nature of the embodiments.

Details associated with the embodiments described above and others are presented below.

BRIEF DESCRIPTION OF THE DRAWINGS

The following drawing illustrates by way of example and not limitation. The figure illustrates some of the described elements using graphical symbols that will be understood by those of ordinary skill in the art. Any of the well-known devices and components described below (such as a computer, a telephone, a mobile phone, a smart phone, a recording device, a global positioning system (GPS) unit, a transmitter, a controller, a sensor, a signaling device, a power supply, etc.) can further be illustrated by generic graphical symbols, and such generic graphical symbols will be understood by those of ordinary skill in the art.

DESCRIPTION OF ILLUSTRATIVE EMBODIMENTS

Figure 1:
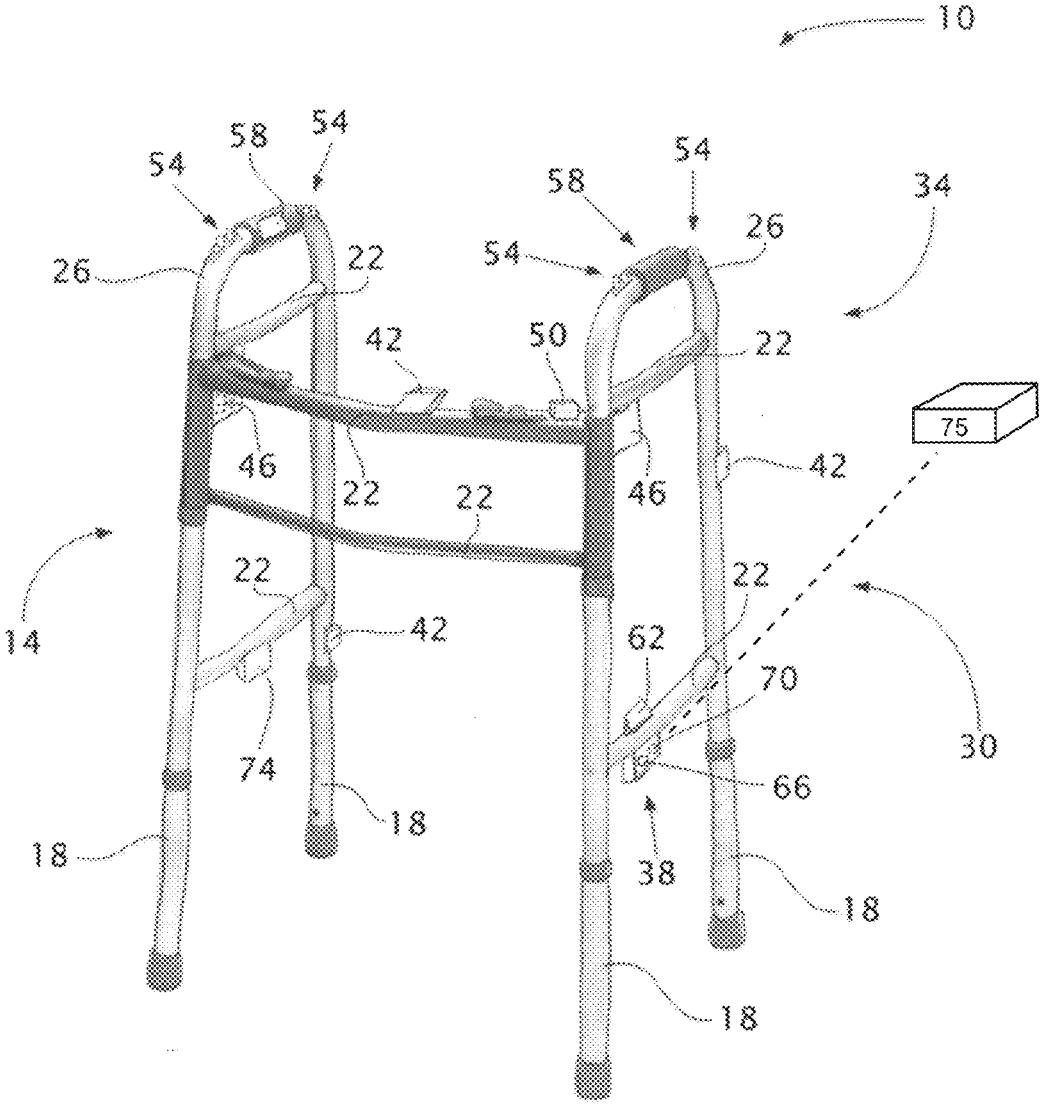
FIG. 1 depicts a perspective view of one embodiment of the present assistive ambulation systems coupled to an assistive ambulation device. Some embodiments of the present invention include the system components and the assistive ambulation device shown in this figure.

FIG. 1 depicts one embodiment of the present assistive ambulation systems. System 10 is configured to be coupled to (and is coupled to) an assistive ambulation device 14, which takes the form a walker but that will be more generally referenced here as frame 14. Frame 14 comprises legs 18, support bars 22, and handles 26. In the embodiment shown, frame 14 includes lower portion 30 and upper portion 34. While a walker is the assistive ambulation device shown in FIG. 1 (other embodiments of which may have wheels), the present systems can be configured to be coupled to any suitable assistive ambulation device, including, but not limited to, front-wheeled walkers, four-wheeled walkers/rollators, hemi-walkers, quad canes (e.g., wide-based or narrow-based), canes (e.g., straight canes with or without a foot-device), wheelchairs (e.g., power wheelchairs), scooters (e.g., power scooters), standard crutches, other crutch types, other motorized mobility devices, and the like (e.g., such as assistive ambulation devices configured to maintain a directional orientation with respect to the user, devices configured to maintain an upright orientation without contact by a user, and devices that are not configured to maintain an upright orientation without contact by a user). In the depicted embodiment, the components of system 10, discussed below, can be connected to frame 14 using any suitable technique, including through the use of structures such as straps, bolts and nuts, screws, adhesives, snaps, clasps, clamps, pins, hook and loop fasteners, and the like.

In the embodiment shown, system 10 comprises controller 38, which is configured to be coupled to an assistive ambulation devices such as frame 14. In the embodiment shown in FIG. 1, controller 38 is coupled to one of support bars 22 of frame 14, but controller 38 can be coupled to any suitable component of frame 14 (e.g., legs 18 or handles 26). The controller of the present assistive ambulation systems is couplable to various other components of system 10, as described in detail below.

System 10 further comprises an initiator sensor that is configured to detect a person (e.g., a user of an assistive ambulation device). In the embodiment shown, system 10 has three initiator sensors 42; however, in other embodiments, system 10 can comprise any number of initiator sensors (e.g., one, two, four, or more initiator sensors) to permit the initiator sensors to detect a person in any desired way. Initiator sensors 42 are configured to be coupled to an assistive ambulation device. For example, in the embodiment shown, some of initiator sensors 42 are coupled to legs 18, and another of initiator sensors 42 is coupled to support bars 22. Further, initiator sensors 42 can be coupled to lower portion 30 of frame 14 or an upper portion 34 of frame 14.

Each of initiator sensors 42 is couplable to controller 38. Initiator sensors 42 can be coupled to controller 38 by any suitable means configured to permit communication between controller 38 and each of initiator sensors 42. For example, in some embodiments, initiator sensors 42 can be coupled to controller 38 by wires (e.g., disposed within frame 14); and in other embodiments, initiator sensors 42 can be coupled to controller 38 wirelessly (e.g., via radio waves).

The initiator sensor or sensors of the present systems can be configured to detect a person in a variety of ways. In some embodiments, a given initiator sensor 42 can be an active sensors. For example, some or all of initiator sensors 42 can be configured to detect motion of a person, such as an ultrasonic sensor, a microwave sensor, a visual sensor (e.g., a CMOS camera), and the like. In other embodiments, a given initiator sensor 42 can be a passive sensor. For example, some or all of initiator sensors 42 can be configured to detect heat of a person, such as an infrared sensor. In still other embodiments, system 10 can comprise a combination of active and passive sensors, such that one or more of the initiator sensors is configured to detect motion of a person and one or more of the initiator sensors is configured to detect heat of a person.

The position and/or orientation of initiator sensors 42 can also be adjusted to detect a person as desired. As described above, initiator sensors 42 can be coupled to lower portion 30 of frame 14 and/or upper portion 34 of frame 14. As an example, the position and/or orientation of initiator sensors 42 coupled to lower portion 30 of frame 14 can permit the initiator sensors to detect a person within a first zone (e.g., a person, for example, standing within the first zone), and the position and/or orientation of initiator sensor 42 coupled to upper portion 34 of frame 14 can permit the initiator sensor to detect a person within a second zone (e.g., a person, for example, lying on an elevated support surface within the second zone). As another example, the position and/or orientation of initiator sensor 42 coupled to lower portion 30 of frame 14 can permit the initiator sensor to detect a desired portion of a person within a first zone (e.g., a person's legs), and the position and/or orientation of initiator sensor 42 coupled to upper portion 34 of frame 14 can permit the initiator sensor to detect a portion of a person within a second zone (e.g., a person's torso). System 10 can accommodate any other quantity, position, and/or orientation of initiator sensors 42 to permit system 10 to detect a person, such as, for example, the layout of a room in which the person will use the system, the shape and size of a given assistive ambulation device, the physical characteristics of a user, and the like.

In some embodiments, when initiator sensors 42 are coupled to an assistive ambulation device, controller 38 can be configured to determine a distance and/or a change in distance between a person and the assistive ambulation device (e.g., based on input received by the controller from initiator sensors 42). For example, initiator sensors 42 can be configured to detect motion of a person by producing a wave and receiving a wave echo, when motion of a person produces a disturbance in the wave echo. Controller 38 can be configured to measure a time interval between the production of the wave and the receipt of a disturbance in the wave echo to determine a distance of a person from initiator sensors 42. Controller 38 can also be configured to measure a change in the time interval over successive iterations to determine a change in distance between a person and the assistive ambulation device.

System 10 further comprises signaling devices 46, 50, and 54, each of which is configured to be coupled to an assistive ambulation device and to produce a signal under the command of controller 38 and based on input from initiator sensors 42 (e.g., when initiator sensors 42 detect a person). For example, one of the initiator sensors can detect a person and signal (or provide input to) the controller, and the controller can signal (or provide input to) one or more of the signaling devices, which in turn will cause the signaling device to produce a signal that is responsive to the initiator sensor's detection of the user.

In the embodiment shown, system 10 comprises eleven signaling devices 46, 50, and 54; however, in other embodiments, system 10 can comprise any number of signaling devices (e.g., one, two, three, four, or more signaling devices) to permit the signaling devices to produce signals in any desired fashion. Signaling devices 46, 50, and 54 can be coupled to an assistive ambulation device, such as frame 14, in any suitable way. For example, in the embodiment shown, signaling devices 46 are each coupled to one of legs 18 and one of support bars 22 of frame 14. Signaling device 50 is coupled to one of support bars 22 of frame 14. Further, signaling devices 54 are each coupled to one of handles 26 of frame 14. However, in other embodiments, signaling devices can be coupled to any portion of an assistive ambulation device (e.g., frame 14) in any configuration to produce any desired signal or combination of signals.

Each of signaling devices 46, 50, and 54 is couplable to controller 38 by any suitable means configured to permit communication between controller 38 and each of signaling devices 46, 50, and 54. For example, in some embodiments, signaling devices 46, 50, and 54 can be coupled to controller 38 by wires (e.g., disposed within frame 14); and in other embodiments, signaling devices 46, 50, and 54 can be coupled to controller 38 wirelessly (e.g., via radio waves).

Signaling devices of the present systems can be configured to produce a variety of signals. For example, signaling devices 46 are configured to produce an auditory signal (e.g., a voice recording (e.g., such as one that is personalized—like the voice of a family member), music, a tone, and the like). As another example, signaling device 50 is configured to produce an olfactory signal (e.g., a scent). As still another example, signaling devices 54 are configured to produce a visual signal, such as, for example, a single-colored light, multi-colored lights, one or more light patterns, and the like. The signals produced by signaling devices 46, 50, and 54 can be preprogrammed and/or programmable (e.g., by a user of an assistive ambulation device). Further, signaling devices 46, 50, and 54 can produce signals with various strengths (e.g., a weak auditory, olfactory, and/or visual signal, a moderate auditory, olfactory, and/or visual signal, a strong auditory, olfactory, and/or visual signal, and similar signal strengths). In some embodiments, the strengths of the signals produced by signaling devices 46, 50, and 54 can be adjustable (e.g., by a user of an assistive ambulation device).

In some embodiments of the present systems, one or more of initiator sensors 42 can be coupled directly to one or more of signaling devices 46, 50, and/or 54 such that input from one or more of initiator sensors 42 directly cues one or more of signaling devices 46, 50, and/or 54 to produce a signal.

In some embodiments, signaling devices 46, 50, and/or 54 are configured to produce one or more of multiple different signals depending on input received from one or more of initiator sensors 42. For example, one of signaling devices 46, 50, and 54 (e.g., signaling devices 54) can be configured to produce a signal (e.g., a light) based on input from one of initiator sensors 42 (e.g., initiator sensor 42 coupled to upper portion 34 of frame 14). Similarly, another of signaling devices 46, 50, and 54 (e.g., signaling devices 46) can be configured to produce a signal (e.g., a sound) based on input from another of initiator sensors 42 (e.g., initiator sensors 42 coupled to lower portion 30 of frame 14). As another example, in some embodiments, signaling devices 46, 50, and/or 54 are configured to produce one or more of multiple different signals depending on a distance and/or a change in distance between a person and an assistive ambulation device. For example, one of signaling devices 46, 50, and 54 (e.g., signaling devices 54) can be configured to produce a first signal (e.g., a light) based on a first distance and/or a first change in distance between a person and an assistive ambulation device (e.g., based on input from one or more of initiator sensors 42). Similarly, another of signaling devices 46, 50, and 54 (e.g., signaling device 50) can be configured to produce a second signal (e.g., a scent) based on a second distance and/or a second change in distance between a person and an assistive ambulation device (e.g., based on input from one or more of initiator sensors 42). The above configurations are exemplary only, and one or more of signaling devices 46, 50, and 54 can be configured to produce a variety of signals based on input from any of initiator sensors 42. Further, one or more signaling devices 46, 50, and/or 54 can be configured to produce a variety of signals depending on a distance and/or a change in distance between a person and an assistive ambulation device.

In some embodiments, signaling devices 46, 50, and/or 54 are configured to produce one or more of signals having different respective strengths depending on input received from one or more of initiator sensors 42, such as input received by the controller from the initiator sensor or sensors, which in turn triggers the controller to send a signal (or otherwise command) the signaling device or devices to produce the signals. For example, one of signaling devices 46, 50, and 54 (e.g., signaling devices 54) can be configured to produce a first signal having a first strength (e.g., producing dim lights) based on input from one of initiator sensors 42 (e.g., initiator sensor 42 coupled to upper portion 34 of frame 14). That signaling device or another of signaling devices 46, 50, and 54 (e.g., signaling devices 54) can be configured to produce a second signal having a second strength (e.g., producing bright lights) based on another input from that initiator sensor, or based on input from another of initiator sensors 42 (e.g., initiator sensors 42 coupled to lower portion 30 of frame 14). The input from one or more of initiator sensors 42 may depend on a distance and/or a change in distance between a person and the assistive ambulation device. For example, one of signaling devices 46, 50, and 54 (e.g., signaling device 50) can be configured to produce a first signal based on a first distance and/or a first change in distance (e.g., producing a strong scent) between a person and an assistive ambulation device (e.g., based on input from one or more of initiator sensors 42). That signaling device or another of signaling devices 46, 50, and 54 (e.g., signaling device 50) can be configured to produce a second signal based on a second distance and/or a second change in distance (e.g., producing a weak scent) between a person and an assistive ambulation device (e.g., based on input from one or more of initiator sensors 42). In this way, a scent or a sound could get quieter or less intense as a user gets closer to the assistive ambulation device. The above configurations are exemplary only, and one or more of signaling devices 46, 50, and 54 can be configured to produce a variety of signals having different respective strengths based on input from any of initiator sensors 42. Further, one or more signaling devices 46, 50, and/or 54 can be configured to produce a variety of signals having different respective strengths depending on a distance and/or a change in distance between a person and an assistive ambulation device.

The control described in the preceding paragraph and throughout this disclosure can, as those of ordinary skill in the art will understand, be accomplished—at least in part—through the use of the controller of a given system. As one example, the controller can be configured to activate a light or lights of a signaling device or devices in a graduated fashion, such as at low, medium, and high levels of brightness that may, for example, have the effect of encouraging a user to continue moving toward and use an assistive ambulation device; the controller may also be configured to—when the user engages the device—activate one or more light-based signaling devices to effect a reward function and/or turn off any activated light(s). As another example, one or more of the signal devices capable of producing an audio signal (such as a person's voice) may be pre-programmed or programmed by a user (or someone for the benefit of a user) to produce varied levels of audio signals depending on the signals received from one or more of the initiator and/or engagement sensors of the system and as interpreted by any desired programming that controls the functions of the controller, so as to produce audio signals that mimic the service of, for example, a butler. Thus, and for example, an initial audio signal (following a sufficient period of non-use, such as 5-10 or more hours) could be a voice stating (for a male user): "Waiting for you, if you please, sir," or (for a female user) "Please, m'lady." The controller may also be configured to increase the level of insistence of the speaker, such as being programmed to, after a pre-determined period of time following activation of the initial audio signal where no engagement of the device has been detected, activate the same or a different signaling device to produce a voice stating (for a male user): "Don't forget the walker, sir," or (for a female user) "Don't forget the walker, m'lady." As another example, a loved one's voice could provide such increasing encouragement, such as (by a grandchild): "[Grandma/Grandpa], please use the walker" and "[Grandma/Grandpa], don't forget to use the walker." The controller may also be configured to—when the user engages the device—activate one or more audio signaling devices to effect a reward function and/or turn off any activated audio signaling devices, such that, for example, pleasant wind down notes are played, or a congratulatory signal (e.g., "Way to go, [Grandma/Grandpa]!"; "Well done, sir!", "Well done, m'lady!", "Thank you, [sir/ma'am]", "Thank you, m'lady").

In the embodiment show, system 10 further comprises engagement sensors 58 and 62 configured to detect if a person has engaged an assistive ambulation device (e.g., when system 10 is coupled to the assistive ambulation device). In the embodiment shown, system 10 comprises three engagement sensors 58 and 62; however, in other embodiments, system 10 can comprise any number of engagement sensors (e.g., one, two, four, or more engagement sensors) to detect if a person engages an assistive ambulation device in any desired manner. In the embodiment shown, engagement sensors 58 are each coupled to one of handles 26 of frame 14, only one of which is visible in FIG. 1 (it will be understood by those of ordinary skill in the art that the engagement sensors can be in the form of material that wraps around all of a portion of the respective handle to which it is connected (such as a touch sensor strip or strips), such that touching the handle with a finger, thumb, and/or webbing of one's hand may trigger the sensor). Engagement sensor 62 is coupled one of support bars 22 of frame 14. However, in other embodiments, engagement sensors can be coupled to any portion of an assistive ambulation device in any configuration to detect in any desired way if a person has engaged the assistive ambulation device.

Each of engagement sensors 58 and 62 is also couplable to controller 38. Engagement sensors 58 and 62 can be coupled to controller 38 by any suitable means configured to permit communication between controller 38 and each of engagement sensors 58 and 62. For example, in some embodiments, engagement sensors 58 and 62 can be coupled to controller 38 by wires (e.g., disposed within frame 14); and in other embodiments, engagement sensors 58 and 62 can be coupled to controller 38 wirelessly (e.g., via radio waves).

The engagement sensor or sensors of embodiments of the present system that include an engagement sensor can be configured to detect if a person engages an assistive ambulation device in a variety of ways. For example, in the embodiment shown, each engagement sensor 58 comprises a tactile sensor (e.g., configured to detect that a person engages an assistive ambulation device if a person touches the assistive ambulation device (or a portion of the assistive ambulation device)). A given tactile sensor may be configured to detect a brief touch, a short touch, or a sustained touch. As another example, engagement sensor 62 comprises an accelerometer. The accelerometer may be configured to detect that a person engages an assistive ambulation device by, more specifically, detecting if the assistive ambulation device moves. The controller may be configured to use the input from the accelerometer to determine and/or record whether the device is still, for how long it has been still, whether its movement is rhythmic (and, thus, representing ambulation), and the duration of movement. The controller may also be programmed to relate one or more of these accelerometer factors to the time of day, to further enable determination of the activity level of a user.

In the embodiment shown, system 10 is configured such that when system 10 is coupled to an assistive ambulation device (e.g., frame 14) and when one or more of engagement sensors 58 and 62 detects that a person engages the assistive ambulation device, signaling devices 46, 50, and 54 are prevented from producing a signal. For example, if one or more of signaling devices 46, 50, and 54 are producing a signal based on input from one or more of initiator sensors 42 and a person engages one or more of engagement sensors 58 (e.g., by touching the corresponding portion of handles 26 of frame 14), the relevant engagement sensor(s) sends a signal to controller 38 and the controller commands (e.g., by sending a signal or signals to) signaling devices 46, 50, and 54 that stops the production of the signal. Controller 38 may also be configured such that, if one or more of signaling devices 46, 50, and 54 are producing a signal based on input from one or more of initiator sensors 42 and a person engages engagement sensor 62 (e.g., by moving the frame 14), the controller commands (e.g., by sending a signal or signals to) signaling devices 46, 50, and 54 to prevent them from producing a signal.

In some embodiments, controller 38 can also be configured to delay preventing signaling devices 46, 50, and/or 54 from producing a signal (or stopping the production of a signal) when a person engages one or more of engagement sensors 58 and 62, such as through a preprogrammed or a programmable time period between when the controller receives the indication that a user has engaged the assistive ambulation device and when the controller commands the relevant signal devices to either stop signaling the user or not to signal the user. For example, controller 38 can be configured such that, if a person engages engagement sensors 58, controller 38 will permit signaling device 50 to produce a signal (e.g., a scent) for a preprogrammed or programmable time interval or a preprogrammed or programmable number of signals prior to preventing signaling device 50 from producing a signal or otherwise stopping the ongoing production of a signal. Controller 38 can be configured to permit such a delay with any of the present signaling devices.

System 10 can further comprise one or more global positioning system (GPS) units (e.g., an Augmented GPS system) that are couplable to controller 38 (e.g., wired or wirelessly) and further couplable to an assistive ambulation device. For example, in one embodiment, a user's smart phone can provide the GPS unit for system 10; and in other embodiments, the GPS unit can be provided in a kit with other components of system 10. System 10 can be configured such that, if one or more GPS units are coupled to an assistive ambulation device, the position of the assistive ambulation device can be determined (e.g., by controller 38, by a remote controller, etc.). One or more GPS units can be coupled to frame 14 in any suitable location (e.g., on handles 26, support bars 22, etc.) to, for example, enable or encourage communication between the one or more GPS units and a remote device (e.g., satellites used to assist in determining the position of the GPS unit(s)). If one or more GPS units are coupled to an assistive ambulation device, the position of the assistive ambulation device can be determined (whether indoors or outdoors), and the position of the assistive ambulation device can, over time, be recorded (e.g., by recording device 66) or transmitted to a remote device (e.g., via controller 38) such that a map of the assistive ambulation device's location—and, therefore, a map of the user's location—can be determined, providing information relating to user activity and range of movement.

In some embodiments, system 10 can comprise recording device 66, which can be couplable to controller 38 and configured to record information relating to system 10 when system 10 is coupled to an assistive ambulation device (e.g., frame 14). For example, recording device 66 can be configured to record a number of times that one or more of initiator sensors 42 detects a person, a number of times that one or more of engagement sensors 58 and 62 detects that a person has engaged the assistive ambulation device, and similar metrics relating to system 10 (and the use thereof). When a sensor (like one of the present initiator or engagement sensors) is triggered and sends input to the controller, the controller can, if so programmed, send a signal to the recording system indicative of the event or occurrence that triggered the sensor. Recording device 66 can be coupled to controller 38 by wires (e.g., disposed within frame 14), or, in other embodiments, wirelessly (e.g., via radio waves).

In some embodiments, system 10 can comprise transmitter 70, which can be couplable to controller 38 and configured to transmit to a remote device (e.g., a mobile telephone, a computer, a base unit in communication with system 10 (e.g., via radio waves), and the like) a signal relating to system 10. For example, in some embodiments, system 10 can communicate with remote devices via telephonic radio waves; and in other embodiments, system 10 can communicate with remote devices via the Internet. In still other embodiments, system 10 can be autonomous in that system 10 does not communicate with remote devices and, instead, for example, can record information relating to system 10 with recording device 66, enabling increased privacy for a user. For example, transmitter 70 can be configured to transmit to a remote device a signal relating to whether one or more of initiator sensors 42 detects a person, a number of times that one or more of engagement sensors 58 and 62 detects that a person has engaged the assistive ambulation device, and similar metrics relating to system 10 (and the use thereof). Transmitter 70 can be coupled to controller 38 by wires (e.g., disposed within frame 14), or, in other embodiments, wirelessly (e.g., via radio waves), and controller 38 may be configured to control transmitter 70. In some embodiments, the remote device may comprise a receiver that, as a result of a signal from or other control by transmitter 70, may activate another device, such as a light (e.g., ambient lighting). The remote device may also be connected to or take the form of autodialer 75, which may function via a land line or through a cellular phone to send a voice or text message as described in more detail below and be activated when the controller detects a certain lack of use of the system and/or an unusual use of the system.

In the embodiment shown, system 10 further comprises power supply 74. Power supply 74 can comprise any suitable device configured to provide power to system 10 and its various components. The power supply can comprise one or more batteries, which can be standard batteries or rechargeable batteries. In some embodiments of the present system that use one or more rechargeable batteries, those one or more batteries can be recharged (e.g., in place) using a wired system or, in other embodiments, an inductive system. In the embodiment shown, power supply 74 is coupled to one of support bars 22; however, in other embodiments, power supply 74 can be coupled to any suitable component of frame 14. Further, power supply 74 is configured to be coupled to at least one of controller 38, one or more of initiator sensors 42, one or more of signaling devices 46, 50, and 54, one or more of engagement sensors 58 and 62, recording device 66, and/or transmitter 70 such that power supply 74 can provide power to system 10. Embodiments of the present systems that include an autodialer, including embodiments other than those that include a transmitter, could also be equipped with a user-operable component (like a button) accessible on an assistive ambulation device that a user could push in an emergency, and that would directly or indirectly activate an autodialing sequence, such as one disclosed herein.

The present disclosure also includes kits comprising system 10 or components of system 10. For example, the disclosure includes a kit comprising one or more controllers (e.g., controller 38), one or more initiator sensors (e.g., initiator sensors 42), one or more signaling devices (e.g., signaling devices 46, 50, and 54), one or more engagement sensors (e.g., engagement sensors 58 and 62), one or more recording devices (e.g., recording device 66), one or more transmitters (e.g., transmitter 70), and/or one or more power supplies (e.g., power supply 74) in any suitable combination. Further, such kits can further comprise instructions for assembly and/or use in a computer-readable form and/or a hard-copy form.

The present controllers can include microprocessors (e.g., a computer or smart phone—and, more specifically, processing components of a computer or smart phone) that are controlled through hardwired logic (such as an application specific integrated circuit) or software (e.g., pre-loaded software, downloadable software (e.g., a mobile application), etc.), or that are programmable (such a field programmable gate array), that performs one or more of the functions and/or steps set forth in this disclosure, and the controllers can include any suitable storage devices for storing data, software, and/or hardware. For example, in some embodiments, software could be downloaded (e.g., as a courtesy or with a one-time or recurring subscription fee) from a website or from a mobile application marketplace. In some embodiments, one or more controllers (e.g., microprocessors) of the present disclosure can be positioned on the assistive ambulation device; and in other embodiments, one or more controllers (e.g., microprocessors) of the present disclosure can be positioned remotely from the assistive ambulation device, and the one or more controllers and the assistive ambulation device can communicate, for example, by a cloud computing network. If one or more controllers are positioned remotely from the assistive ambulation device, data can be processed remotely from the assistive ambulation device (e.g., in a centralized location) and transmitted wirelessly (e.g., via the Internet) to and from the assistive ambulation device and/or other devices in communication with the one or more controllers and/or the assistive ambulation device. Such a configuration could enable real-time and/or automatic software upgrades.

Figure 2:
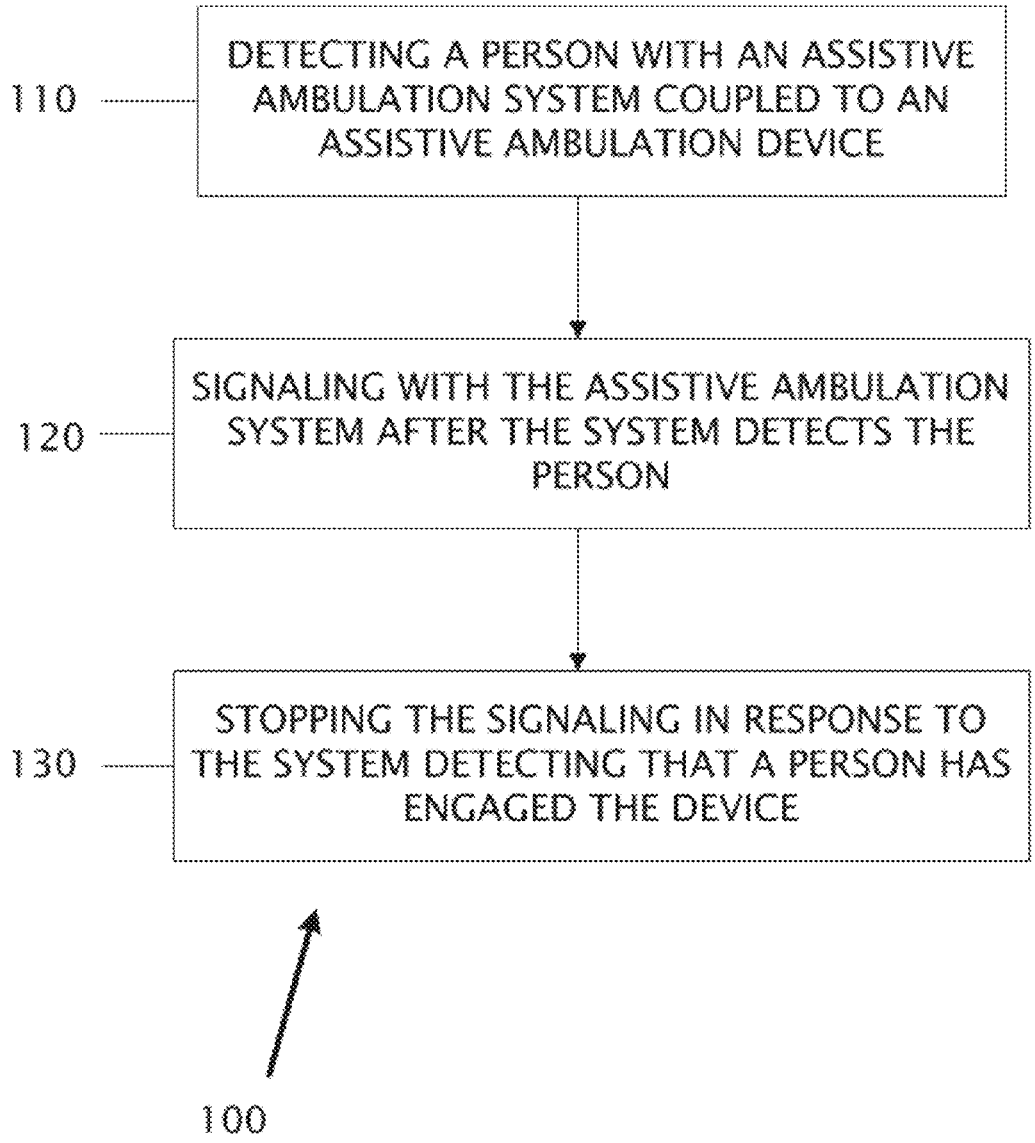
FIG. 2 depicts steps of one of the present assistive ambulation methods.
Figure 3:
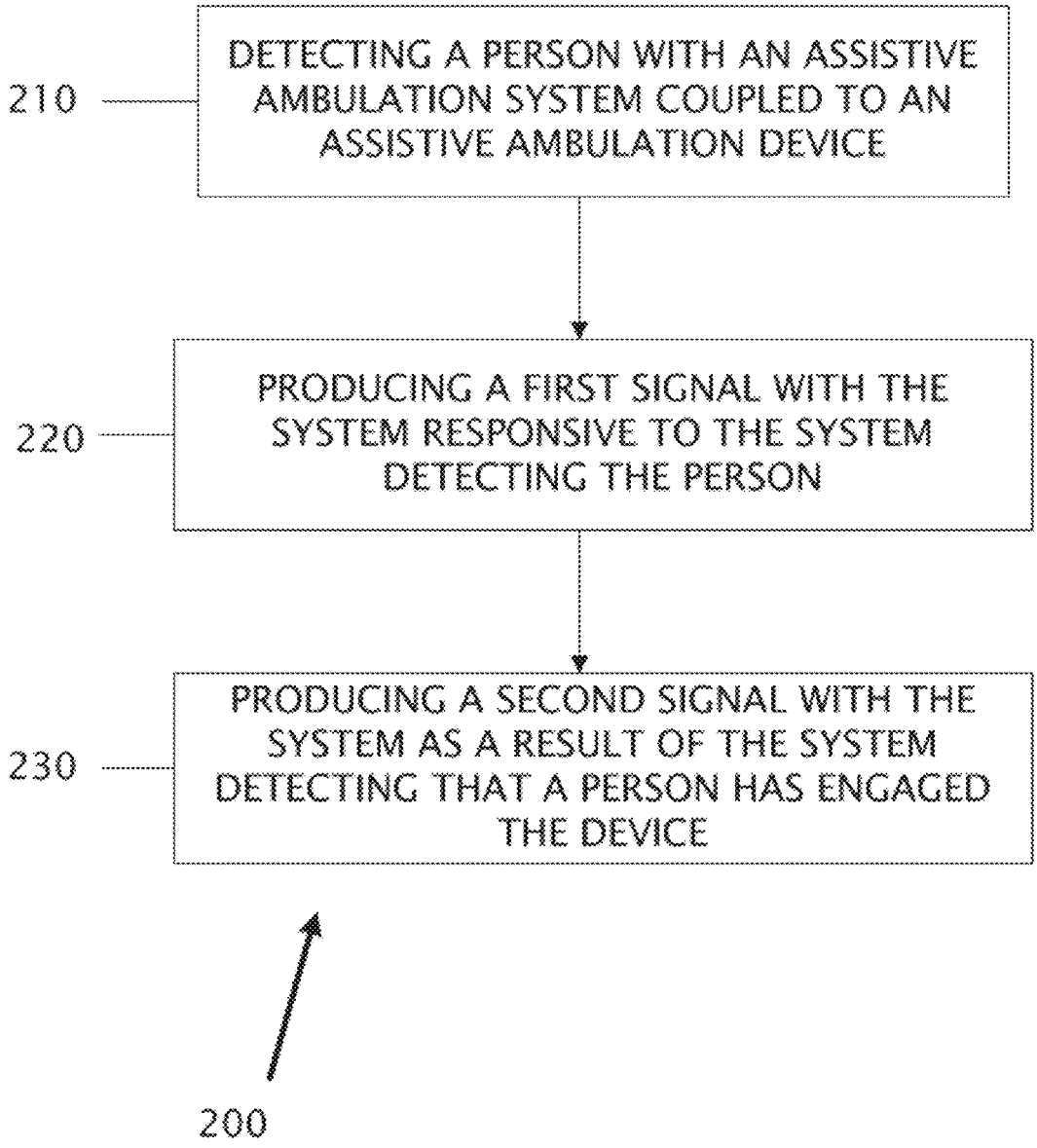
FIG. 3 depicts steps of another of the present assistive ambulation methods.

The present disclosure also includes assistive ambulation methods. Such methods can comprise detecting a person (e.g., with an assistive ambulation system (e.g., system 10) coupled to an assistive ambulation device (e.g., frame 14)); signaling with the assistive ambulation system when the assistive ambulation system detects the person; and preventing the assistive ambulation system from signaling when the assistive ambulation system detects that a person has engaged the assistive ambulation device. One embodiment of such methods is method 100, shown in FIG. 2, which includes step 110—detecting a person with an assistive ambulation system coupled to an assistive ambulation device; step 120—signaling with the assistive ambulation system after the assistive ambulation system detects the person; and step 130—stopping the signaling when the assistive ambulation system detects that a person has engaged the assistive ambulation device. Step 120 may comprise detecting a person's state of position (e.g., sitting up from a rested position, standing, etc.) and/or motion (e.g. moving toward the device), as determined by one or more initiator sensors and the controller of the system. Other embodiments of the present methods, such as method 200 shown in FIG. 3, include step 210—detecting a person with an assistive ambulation system coupled to an assistive ambulation device; step 220—producing a first signal with the assistive ambulation system responsive to the assistive ambulation system detecting the person; and step 230—producing a second signal with the assistive ambulation system as a result of the assistive ambulation system detecting that a person has engaged the assistive ambulation device. Step 220 may comprise detecting a person's state of position (e.g., sitting up from a rested position, standing, etc.) and/or motion (e.g. moving toward the device), as determined by one or more initiator sensors and the controller of the system.

In some embodiments, detecting a person can comprise detecting motion of a person and/or detecting heat of a person. In some embodiments, signaling comprises producing an auditory signal (e.g., a voice recording), producing a visual signal (e.g., one or more lights (e.g., multi-colored lights)), and/or producing an olfactory signal (e.g., a scent, such as with a scent atomizer). Further, in some embodiments, signaling can comprise producing one or more of signals having different respective strengths depending on a person's proximity to the assistive ambulation device, or, in other embodiments, depending on a person's state of position and/or motion, as determined by one or more initiator sensors and the controller of the system. In other embodiments, signaling can comprise producing one or more of multiple different signals depending on a person's proximity to the assistive ambulation device. In still other embodiments, signaling can comprise producing one or more of signals having different respective strengths depending on motion that the assistive ambulation system detects. In still other embodiments, signaling comprises producing one or more of multiple different signals depending on motion that the assistive ambulation system detects. In some embodiments, the assistive ambulation system detects that a person has engaged the assistive ambulation device when a person touches the assistive ambulation device; and in other embodiments, the assistive ambulation system detects that a person has engaged the assistive ambulation device when a person moves the assistive ambulation device.

Some embodiments of the present methods can further comprise recording information relating to the assistive ambulation system. In some embodiments, information relating to the assistive ambulation system comprises a number of times that the assistive ambulation system detects a person, a number of times that a person engages the assistive ambulation device, and the like.

Some embodiments of the present methods can also comprise transmitting to a remote device (e.g., a computer, a mobile telephone, a base unit, a receiver, and the like) a signal relating to the assistive ambulation system. In some embodiments, the signal relates to a number of times that the assistive ambulation system detects a person, a number of times that a person engages the assistive ambulation device, and the like. In some embodiments, the signal may trigger the remote device to activate another device or perform another function, such as turning on ambient lights and/or auto-dialing a given phone number (e.g., in circumstances determined by the controller to indicate unusual user behavior) until the phone call is received (e.g., starting first with one or more family members and then, if the call goes unanswered for a given period of time, to local medical emergency responder(s)) The device activated by the transmitter could be configured to receive a reply signal and, if a reply signal is not received in a sufficient amount of time, repeat the auto-dialing.

Example Mobility Scenarios

Some embodiments of the present systems may be configured to respond to one or more of the following example mobility scenarios:

A user getting up from bed; sitting at the edge of bed; and or coming to a stand from bed. A user walking with a walker. A user standing with the aid of a walker. A user moving in a bathroom. A user sitting in chair in room. A user sitting in lobby, such as in an assisted living facility. A user walking away from a walker. A user in a dining room in assisted living facility. Someone (e.g., facility staff) abruptly moving a walker. A walker tipped from an upright position, such as might occur as a result of a fall. A walker not being used at a usual first waking and walking time.

Example User State Determinations

The controller of embodiments of the present systems may be configured—through, for example, programming that controls a microprocessor via software and/or hardwiring—to determine one or more of the following example states, using input from one or more sensors (e.g., initiator sensors and/or engagement sensors):

A user is in bed, where example factors or inputs affecting such a determination may include: nighttime hours, no output from any sensors for a certain amount (e.g., 5 hours or more) of time (or output representing non-activation), low power usage, and no activation (or output representing non-activation) of accelerometer.

A user is swinging his/her legs off the edge of a bed, where example factors or input affecting such a determination may include no output from any touch sensors (or output representing non-activation), activation (e.g., new activation, such as activation following a pre-determined period of time (e.g., 5 or more hours)) of sensor(s) directed at a zone/field encompassing space no higher than, e.g., 4 feet from a ground surface (e.g., 2 feet), no activation (or output representing non-activation) of sensor(s) directed at a zone/field encompassing space as high and/or higher than, e.g., 4 feet from a ground surface (e.g., 5 feet), and no activation (or output representing non-activation) of accelerometer.

A user is sitting up and sitting at the edge of a bed, where example factors or input affecting such a determination may include no output from any touch sensors (or output representing non-activation), activation/continued activation of sensor(s) directed at a zone/field encompassing space no higher than, e.g., 4 feet from a ground surface (e.g., 2 feet), activation (e.g., new activation, such as activation following a pre-determined period of time (e.g., 5 or more hours)) of sensor(s) directed at a zone/field encompassing space as higher and/or higher than, e.g., 4 feet from a ground surface (e.g., 2 feet), and no activation (or output representing non-activation) of accelerometer.

A user is coming to a stand, where example factors or input affecting such a determination may include no output from any touch sensors (or output representing non-activation), activation/continued activation of sensor(s) directed at a zone/field encompassing space no higher than, e.g., 4 feet from a ground surface, activation/continued activation of sensor(s) directed at a zone/field encompassing space as higher and/or higher than, e.g., 4 feet from a ground surface, activation (e.g., new activation, such as activation following a pre-determined period of time (e.g., 5 or more hours)) of sensor(s) for detecting decreased distance to the assistive ambulation device, and no activation (or output representing non-activation) of accelerometer.

A user is standing with both hands on a walker, where example factors or input affecting such a determination may include activation of touch sensors on both handles of the walker, activation/continued activation of sensor(s) directed at a zone/field encompassing space no higher than, e.g., 4 feet from a ground surface, activation/continued activation of sensor(s) directed at a zone/field encompassing space as higher and/or higher than, e.g., 4 feet from a ground surface, and no activation (or output representing non-activation) of accelerometer.

Example System Response

Embodiments of the present systems could be configured to respond to the following example system-determined scenario—a user, who is usually out of bed by 7 AM, has not activated any walker sensor by 8 AM—in the example following manner: the controller of the system activates a low power radio transmitter that then activates an autodialer, which dials a number (and then a series of numbers, if the call is not completed) as predetermined by the user and/or his/her family, such as a family member(s) first and, subsequently, an emergency responder second. The autodialer may deliver a voice or text message. The autodialer may be configured to receive a signal, such as a return call from one or more specific phone numbers or receipt of a return call from any number and the input of a certain code, and stop auto-dialing as a result. Embodiments of the present systems could be configured to produce a similar sequence in response to a determination that a user has not activated a sensor for several hours during the day, which could indicate a fall.

The above specification and examples provide a complete description of the structure and use of exemplary embodiments. Although certain embodiments have been described above with a certain degree of particularity, or with reference to one or more individual embodiments, those skilled in the art could make numerous alterations to the disclosed embodiments without departing from the scope of this invention. As such, the various illustrative embodiments of the present systems and methods are not intended to be limited to the particular forms disclosed. Rather, they include all modifications and alternatives falling within the scope of the claims, and embodiments other than the one shown may include some or all of the features of the depicted embodiment. For example, components may be combined as a unitary structure and/or connections may be substituted. Further, where appropriate, aspects of any of the examples described above may be combined with aspects of any of the other examples described to form further examples having comparable or different properties and addressing the same or different problems. Similarly, it will be understood that the benefits and advantages described above may relate to one embodiment or may relate to several embodiments.

The claims are not intended to include, and should not be interpreted to include, means-plus- or step-plus-function limitations, unless such a limitation is explicitly recited in a given claim using the phrase(s) "means for" or "step for," respectively.

The invention claimed is:

1. A system comprising:

an initiator sensor configured to detect a person;

a controller couplable to the initiator sensor;

a signaling device couplable to the controller, the controller configured to cause the signaling device to produce a signal based on input received by the controller from the initiator sensor after the initiator sensor detects a person;

an engagement sensor couplable to the controller and configured such that, if coupled to an assistive ambulation device, the engagement sensor can detect if a person has engaged the assistive ambulation device; and a power supply couplable to at least one of the controller, the initiator sensor, the signaling device, and the engagement sensor;

where the controller is configured such that, when the system is coupled to or includes an assistive ambulation device, the controller causes the signaling device to produce a different signal after the engagement sensor has detected that a person has engaged the assistive ambulation device.

2. The system of claim 1, where the controller is configured such that, when the system is coupled to or includes an assistive ambulation device, the controller prevents the signaling device from producing a signal after the engagement sensor has detected that a person has engaged the assistive ambulation device.

3. The system of claim 1, further comprising:

an autodialer couplable to the controller.

4. The system of claim 1, further comprising:

a second signaling device couplable to the controller;

where the controller is configured such that, when the system is coupled to or includes an assistive ambulation device, the controller causes the second signaling device to produce a signal after the engagement sensor has detected that a person has engaged the assistive ambulation device.

5. The system of claim 1, further comprising:

an assistive ambulation device coupled to the initiator sensor, the controller, the signaling device, the engagement sensor, and the power supply.

6. The system of claim 1, where the controller is configured such that, when the system is coupled to or includes an assistive ambulation device, the controller can determine at least one of a distance between a person and the assistive ambulation device and a change in distance between a person and the assistive ambulation device.

7. The system of claim 1, further comprising:

a recording device couplable to the controller and configured to record information relating to the system when the system is coupled to an assistive ambulation device.

8. The system of claim 1, further comprising:

a transmitter couplable to the controller and configured to transmit to a remote device a signal relating to the system.

9. The system of claim 8, where the controller is configured to cause the transmitter to transmit a signal relating to whether the initiator sensor has detected a person.

10. The system of claim 8, where the controller is configured to cause the transmitter to transmit a signal relating to whether the engagement sensor has detected that a person has engaged the assistive ambulation device.

11. A system comprising:

an initiator sensor configured to detect a person;

a controller couplable to the initiator sensor;

a signaling device couplable to the controller, the controller configured to cause the signaling device to produce a first signal based on input received by the controller from the initiator sensor after the initiator sensor detects a person; and a power supply couplable to at least one of the controller, the initiator sensor, and the signaling device;

where the controller is configured such that, when the system is coupled to or includes an assistive ambulation device, the controller can stop the signaling device from producing the first signal after a person has engaged the assistive ambulation device; and where the controller is configured such that, when the system is coupled to or includes an assistive ambulation device, the controller causes the signaling device to produce a different signal as a result of a person having engaged the assistive ambulation device.

12. The system of claim 11, further comprising:

an engagement sensor couplable to the controller and configured to detect if a person has engaged an assistive ambulation device when the system is coupled to or includes the assistive ambulation device;

where the engagement sensor comprises at least one of a tactile sensor and an accelerometer.

13. The system of claim 11, where the system further comprises:

a second signaling device couplable to the controller;

where the controller is configured such that, when the system is coupled to or includes an assistive ambulation device, the controller causes the second signaling device to produce a signal after a person has engaged the assistive ambulation device.

14. The system of claim 11, further comprising:

an assistive ambulation device coupled to the initiator sensor, the controller, the signaling device, and the power supply.

15. The system of claim 11, where the initiator sensor comprises a first initiator sensor that is coupled to a lower portion of the assistive ambulation device, and the system further comprises:

a second initiator sensor coupled to an upper portion of the assistive ambulation device.

16. The system of claim 11, further comprising:

a transmitter couplable to the controller and configured to transmit to a remote device a signal relating to the system.

17. A system comprising:

an initiator sensor configured to detect a person;

a controller couplable to the initiator sensor;

an autodialer couplable to the controller;

a signaling device couplable to the controller, the controller configured to cause the signaling device to produce a signal based on input received by the controller from the initiator sensor after the initiator sensor detects a person;

an engagement sensor couplable to the controller and configured such that, if coupled to an assistive ambulation device, the engagement sensor can detect if a person has engaged the assistive ambulation device; and a power supply couplable to at least one of the controller, the initiator sensor, the signaling device, and the engagement sensor.

18. A system comprising:

an initiator sensor configured to detect a person;

a controller couplable to the initiator sensor;

a signaling device couplable to the controller, the controller configured to cause the signaling device to produce a signal based on input received by the controller from the initiator sensor after the initiator sensor detects a person;

an engagement sensor couplable to the controller and configured such that, if coupled to an assistive ambulation device, the engagement sensor can detect if a person has engaged the assistive ambulation device; and a power supply couplable to at least one of the controller, the initiator sensor, the signaling device, and the engagement sensor;

where the controller is configured such that, when the system is coupled to or includes an assistive ambulation device, the controller can determine at least one of a distance between a person and the assistive ambulation device and a change in distance between a person and the assistive ambulation device.

19. The system of claim 18, where the controller is configured such that, when the system is coupled to or includes an assistive ambulation device, the controller prevents the signaling device from producing a signal after the engagement sensor has detected that a person has engaged the assistive ambulation device.

20. The system of claim 18, where the controller is configured such that, when the system is coupled to or includes an assistive ambulation device, the controller causes the signaling device to produce a different signal after the engagement sensor has detected that a person has engaged the assistive ambulation device.

21. The system of claim 18, further comprising:

an autodialer couplable to the controller.

22. The system of claim 18, further comprising:
a second signaling device couplable to the controller;
where the controller is configured such that, when the system is coupled to or includes an assistive ambulation device, the controller causes the second signaling device to produce a signal after the engagement sensor has detected that a person has engaged the assistive ambulation device.

23. The system of claim 18, further comprising:
an assistive ambulation device coupled to the initiator sensor, the controller, the signaling device, the engagement sensor, and the power supply.

24. The system of claim 18, where the controller is configured such that, when the system is coupled to or includes an assistive ambulation device, the controller can determine at least one of a distance between a person and the assistive ambulation device and a change in distance between a person and the assistive ambulation device.

25. The system of claim 18, further comprising:
a recording device couplable to the controller and configured to record information relating to the system when the system is coupled to an assistive ambulation device.

26. The system of claim 18, further comprising:
a transmitter couplable to the controller and configured to transmit to a remote device a signal relating to the system.

27. The system of claim 26, where the controller is configured to cause the transmitter to transmit a signal relating to whether the initiator sensor has detected a person.

28. The system of claim 26, where the controller is configured to cause the transmitter to transmit a signal relating to whether the engagement sensor has detected that a person has engaged the assistive ambulation device.

29. A system comprising:
an initiator sensor configured to detect a person;
a controller couplable to the initiator sensor;
a signaling device couplable to the controller, the controller configured to cause the signaling device to produce a signal based on input received by the controller from the initiator sensor after the initiator sensor detects a person;
an engagement sensor couplable to the controller and configured such that, if coupled to an assistive ambulation device, the engagement sensor can detect if a person has engaged the assistive ambulation device;
a power supply couplable to at least one of the controller, the initiator sensor, the signaling device, and the engagement sensor; and
a recording device couplable to the controller and configured to record information relating to the system when the system is coupled to an assistive ambulation device.

30. A system comprising:
an initiator sensor configured to detect a person;
a controller couplable to the initiator sensor;
a signaling device couplable to the controller, the controller configured to cause the signaling device to produce a signal based on input received by the controller from the initiator sensor after the initiator sensor detects a person;
an engagement sensor couplable to the controller and configured such that, if coupled to an assistive ambulation device, the engagement sensor can detect if a person has engaged the assistive ambulation device;
a power supply couplable to at least one of the controller, the initiator sensor, the signaling device, and the engagement sensor; and
a transmitter couplable to the controller and configured to transmit to a remote device a signal relating to the system.

31. The system of claim 30, where the controller is configured to cause the transmitter to transmit a signal relating to whether the initiator sensor has detected a person.

32. The system of claim 31, where the controller is configured to cause the transmitter to transmit a signal relating to whether the engagement sensor has detected that a person has engaged the assistive ambulation device.

33. A system comprising:
an initiator sensor configured to detect a person;
a controller couplable to the initiator sensor;
a signaling device couplable to the controller, the controller configured to cause the signaling device to produce a first signal based on input received by the controller from the initiator sensor after the initiator sensor detects a person; and
a power supply couplable to at least one of the controller, the initiator sensor, and the signaling device;
where the controller is configured such that, when the system is coupled to or includes an assistive ambulation device, the controller can stop the signaling device from producing the first signal after a person has engaged the assistive ambulation device; and
where the initiator sensor comprises a first initiator sensor that is coupled to a lower portion of the assistive ambulation device, and the system further comprises:
a second initiator sensor coupled to an upper portion of the assistive ambulation device.

34. The system of claim 33, where the controller is configured such that, when the system is coupled to or includes an assistive ambulation device, the controller causes the signaling device to produce a different signal as a result of a person having engaged the assistive ambulation device.

35. The system of claim 33, further comprising:
an engagement sensor couplable to the controller and configured to detect if a person has engaged an assistive ambulation device when the system is coupled to or includes the assistive ambulation device;
where the engagement sensor comprises at least one of a tactile sensor and an accelerometer.

36. The system of claim 33, where the system further comprises:
a second signaling device couplable to the controller;
where the controller is configured such that, when the system is coupled to or includes an assistive ambulation device, the controller causes the second signaling device to produce a signal after a person has engaged the assistive ambulation device.

37. The system of claim 33, further comprising:
an assistive ambulation device coupled to the initiator sensor, the controller, the signaling device, and the power supply.

38. The system of claim 33, further comprising:
a transmitter couplable to the controller and configured to transmit to a remote device a signal relating to the system.

39. A system comprising:
an initiator sensor configured to detect a person;
a controller couplable to the initiator sensor;
a transmitter couplable to the controller and configured to transmit to a remote device a signal relating to the system;
a signaling device couplable to the controller, the controller configured to cause the signaling device to produce a first signal based on input received by the controller from the initiator sensor after the initiator sensor detects a person; and a power supply couplable to at least one of the controller, the initiator sensor, and the signaling device;

where the controller is configured such that, when the system is coupled to or includes an assistive ambulation device, the controller can stop the signaling device from producing the first signal after a person has engaged the assistive ambulation device.

40. The system of claim 39, where the controller is configured such that, when the system is coupled to or includes an assistive ambulation device, the controller causes the signaling device to produce a different signal as a result of a person having engaged the assistive ambulation device.

41. The system of claim 39, further comprising:

an engagement sensor couplable to the controller and configured to detect if a person has engaged an assistive ambulation device when the system is coupled to or includes the assistive ambulation device;

where the engagement sensor comprises at least one of a tactile sensor and an accelerometer.

42. The system of claim 39, where the system further comprises:

a second signaling device couplable to the controller;

where the controller is configured such that, when the system is coupled to or includes an assistive ambulation device, the controller causes the second signaling device to produce a signal after a person has engaged the assistive ambulation device.

43. The system of claim 39, further comprising:

an assistive ambulation device coupled to the initiator sensor, the controller, the signaling device, and the power supply.

* * * * *